United States Patent [19]

Johns

[11] 4,335,386

[45] Jun. 15, 1982

[54] BIFILAR ANTENNA TRAP

[76] Inventor: Robert H. Johns, 3379 Papermill Rd., Huntingdon Valley, Pa. 19006

[21] Appl. No.: 222,241

[22] Filed: Jan. 2, 1981

Related U.S. Application Data

[63] Continuation-in-part of Ser. No. 162,928, Jul. 17, 1980.

[51] Int. Cl.[3] ..... H01Q 9/20; H01Q 1/14

[52] U.S. Cl. ..... 343/722

[58] Field of Search ..... 333/175, 185; 343/722, 343/790, 791, 792, 859

[56] References Cited

U.S. PATENT DOCUMENTS

| | | | |
|---|---|---|---|
| 2,129,514 | 9/1938 | Wertheimer | 343/749 |
| 2,422,458 | 6/1947 | Amy et al. | 343/722 |
| 3,419,869 | 12/1968 | Altmayer | 343/749 |
| 3,560,895 | 2/1971 | Matsumoto | 333/175 |
| 4,255,728 | 3/1981 | Doty | 333/185 |

*Primary Examiner*—Eli Lieberman

[57] ABSTRACT

Antenna traps without a separate capacitor component are disclosed. The traps are tuned by the capacitance between bifilar coils employed as the trap inductor. Simplicity, low cost, and ease of fabrication are the advantages of this trap. A method of winding a trap antenna from a continuous wire that becomes both antenna segments and resonant traps is also disclosed.

5 Claims, 9 Drawing Figures

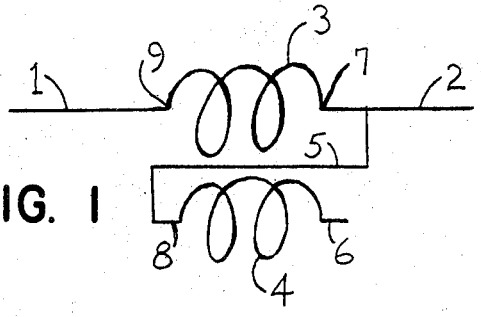
FIG. 1
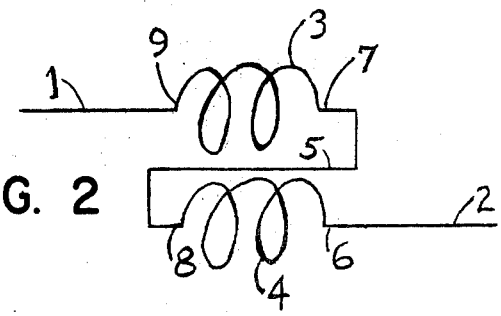
FIG. 2
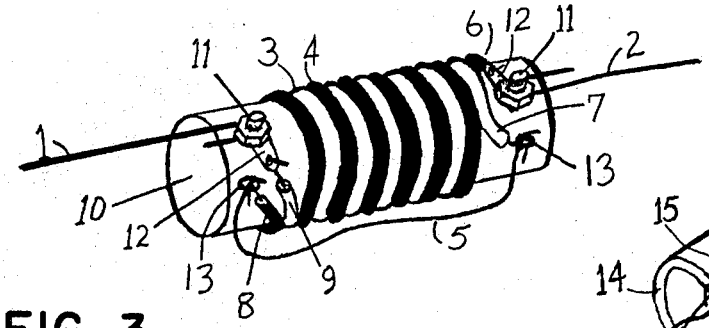
FIG. 3
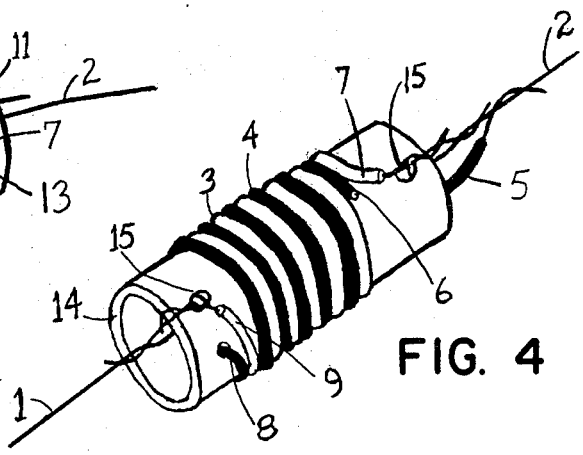
FIG. 4
FIG. 5A
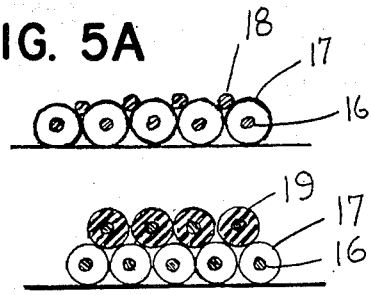
FIG. 5B
FIG. 6A
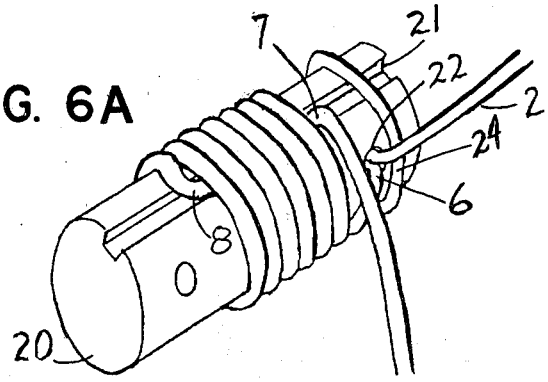
FIG. 7
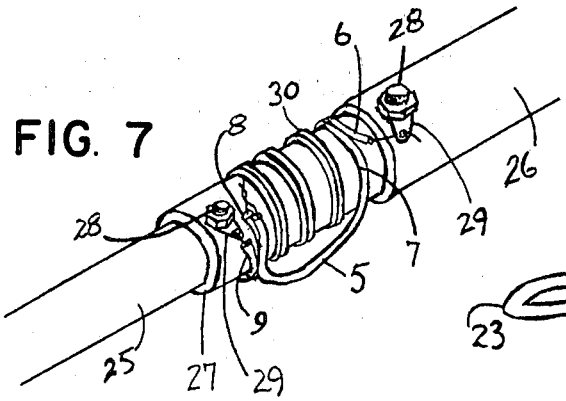
FIG. 6B
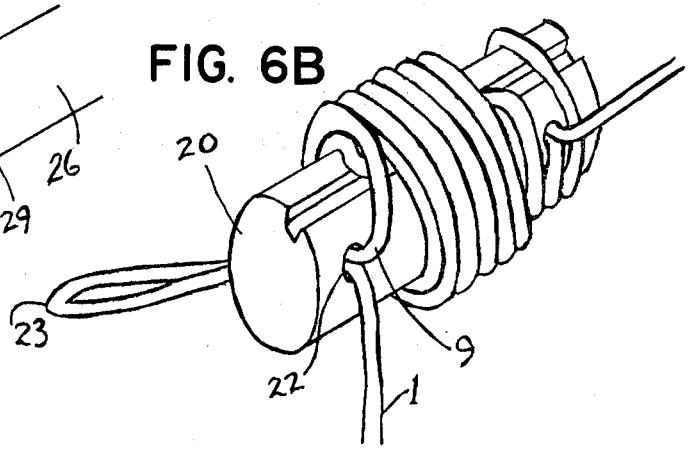

BIFILAR ANTENNA TRAP

This application is a continuation-in-part of my application Ser. No. 06/162,928, filed July 17, 1980.

BACKGROUND OF THE INVENTION

This invention relates to improvements in the art of constructing antenna traps which are used to provide multiband operation on a single antenna. A trap is a parallel resonant circuit inserted in an antenna and which offers a high impedance to currents flowing in the antenna at the trap's resonant frequency, separating the inner portion of the antenna between the feedline and the trap from the remainder of the antenna. The inner portion is of a length to resonate at the trap frequency and is an efficient radiator and absorber of radio waves of that frequency and nearby band of frequencies. Many traps can be incorporated into a single antenna, enabling the antenna to be used on many bands. Traps are well known and used in many types of antennas, such as dipoles, vertical monopoles, parasitic beams, and the like.

PRIOR ART

Typical trap constructions include both an inductor and a capacitor to establish a parallel resonant circuit, though in some antennas made from tubing the capacitor is incorporated into the structure as a coaxial rod or tube inside and insulated from the antenna tubing. In this invention, the trap capacitor is eliminated as a separate component and the capacitance between series-connected bifilar coil windings is employed to resonate the coil's inductance to the desired trap frequency. Carlson, in U.S. Pat. No. 3,465,267 has employed the interwinding capacitance between bifilar coils to produce a parallel resonant circuit in his generalized circuit component, and Matsumoto, in U.S. Pat. No. 3,560,895, has used the capacitance between bifilar coils to tune an interstage transformer to a resonant frequency. Neither of these prior art devices is suitable for antenna trap use because of mechanical support and electrical connector deficiences. In my application Ser. No. 06/162,928, an antenna trap is disclosed that utilises the capacitance between the inner and outer conductors of coaxial cable as the trap capacitor, thus eliminating a separate component in a trap in which the coaxial cable outer braid is used as the trap inductor. This invention includes another novel structure that does not need a separate capacitor in an antenna trap, that is realized with ordinary insulated wire.

SUMMARY OF THE INVENTION

In this invention, a parallel resonant trap circuit is constructed from insulated wire bifilar coils, without employing a separate capacitor. The capacitance between the windings is electrically in parallel with the coil inductance to tune the trap to a resonant frequency. As more turns of wire are wound into the bifilar coils, both the inductance and capacitance are increased, lowering the trap frequency and providing a convenient way of preparing traps of different frequency. The traps are of very simple construction and low cost. A further provision of this invention is a method whereby these bifilar traps may be included into a trap antenna without requiring any electrical connections within the traps or between the traps and the antenna wire.

BRIEF DESCRIPTION OF THE DRAWINGS

FIG. 1 is a schematic diagram of one embodiment of the bifilar antenna trap.

FIG. 2 is a schematic diagram of an alternate embodiment of a bifilar antenna trap.

FIG. 3 is a perspective view of one embodiment of this invention that utilizes the coil connection illustrated in FIG. 2.

FIG. 4 is a perspective view of an alternate embodiment of this invention that utilizes the coil connection illustrated in FIG. 1.

FIGS. 5A and 5B shows two different alternate coil winding configurations in cross-section.

FIGS. 6A and 6B show two perspective views of the winding of a bifilar trap so that the coil wire is continuous with the antenna wire on either side of the trap.

FIG. 7 shows a perspective view of a bifilar trap for use in antennas made from metal tubing.

DETAILED DESCRIPTION OF THE INVENTION

In FIG. 1, bifilar trap coils 3 and 4 are included between antenna segments 1 and 2. A cross-connection 5 joins opposite ends of the bifilar coils 7 and 8, joining the two coils in series so that their inductances reinforce or aid one another, rather than oppose one another. This connection makes one large coil out of the two smaller coils as to magnetic or inductive effects. The usual distributed capacity between adjacent turns of a coil is greatly increased by this bifilar winding, since the bifilar turns that are adjacent one another, such as those at the left end of the coils 8 and 9, have much greater rf voltage between them than adjacent turns in the same coil. This capacitance between bifilar coils is in parallel with the combined coil inductance and forms a parallel resonant circuit with the bifilar coils. Antenna segments 1 and 2 are connected to the ends of only one of the bifilar coils, coil 3. The high impedance offered by the trap at resonance is still a high impedance and the trap still functions to disconnect unwanted antenna segments from the resonant one, and at lower frequencies the single coil offers less impedance as a loading coil. This is an advantage in applications where wide bandwidth is desired, since the presence of large loading inductors restricts the bandwidth of an antenna.

In FIG. 2 a similar pair of bifilar coils is shown, together with the cross-connection 5, as in FIG. 1. The antenna segments 1 and 2 in this configuration are connected to the ends of the overall inductance formed by the two bifilar coils in series. This antenna connection does not affect the resonant frequency except to a minor degree, but places both coils in the antenna as loading coils at lower frequencies. This arrangement is an advantage in applications where the maximum loading or shortening of the physical length of the trap antenna is desired.

It will be appreciated that the ratio of inductance to capacitance in the trap circuit can be controlled by changing the number of turns of wire in the second coil 4 of FIG. 1, since these coils need not have the same number of turns. Also, the amount of loading inductance that the trap will exhibit at lower frequencies can be adjusted by changing the location of the connections of the antenna to the bifilar coils.

In FIG. 3 a bifilar antenna trap is shown wound on an insulator 10, with bolts 11 securing antenna wires 1 and 2 to the trap insulator and also holding connecting lugs 12 in contact with the antenna wires. Lugs 12 are also connected to ends 9 and 6 of the bifilar coils. Terminals 13 are also mounted on the trap insulator, connected to coil ends 7 and 8 and the ends of cross-connection wire 5. Coils 3 and 4 are shown of different color to aid in identifying them. The white coil 3 starts at the left end of the insulator, connected to antenna segment 1, and finishes at the right end at 7 and is connected by cross-connection wire 5 to the starting end of black coil 4 which finishes at 6 and is connected to antenna segment 2. Electrically this trap is shown in FIG. 2. It should be noted that the trap insulator must be of a nonconductive material even when the bifilar coils are themselves insulated, since eddy current losses in a conducting support form for the coils would reduce the effectiveness of the trap.

In FIG. 4 a hollow trap insulator is shown whereby the cross-connection wire 5 may pass through the center of the trap and insulator 14. A separate wire is not used for the cross-section, but rather an extension of the black coil 4 at the start 8 of the winding passes through a hole in the trap insulator 14 and through the axis of the insulator to connect to bifilar coil end 7 and antenna segment 2 at the opposite end of the trap. The trap shown in FIG. 4 uses the electrical connection of FIG. 1 in which antenna segments are connected across only one of the bifilar coils, the white coil 3, at its ends 9 and 7. Antenna segments 1 and 2 are secured to the trap insulator by means of holes 15 drilled in the wall of the insulator. Electrical connections between coil and antenna are effected by connecting coil ends directly to antenna wire and soldering. End 6 of bifilar coil 4 is left unconnected in this arrangement.

The traps shown in FIGS. 3 and 4 may be turned over a small frequency range by adjusting the spacing between the bifilar turns. Both coils 3 and 4 have been shown wound with insulated wire but since they must only be insulated from one another, one of the coils may be wound with uninsulated wire, thereby reducing the separation of the bifilar turns and increasing the capacitance between the coils. A relatively thick insulation has been shown in the drawings but in some applications a relatively thin insulation such as an enamel or plastic coating will be more appropriate.

In FIG. 5(*a*) a cross-section of a pair of bifilar coils is shown in which the coils are wound one on top of the other. The bottom coil is wound with wire 16 having an insulated covering 17, and the second or outer coil is wound from uninsulated wire 18. In FIG. 5(*b*) both coils are made from insulated wire, the bottom coil having white insulation 17 and the outer coil having dark insulation 19. The essential bifilar relationship is preserved in this configuration, and exists even if the two coils are wound from a single continuous wire, doubling back on itself to achieve the necessary sense or direction of the winding.

In FIG. 6 two views of the winding of a bifilar antenna trap are shown in which a trap can be introduced into an antenna with no breaks or electrical connections required. The winding begins with the electrical center of the bifilar coils, the cross-connection wire. The insulated wire is laid lengthwise on the trap insulator 20, preferably into a longitudinal slot 21 in the insulator. In FIG. 6(*a*) the first of the bifilar coils has been completed. It was started by bringing the wire out of the slot toward the left end of the insulator 8, bending the wire 90° to the slot away from the observer, and winding the wire around the insulator and cross-connection wire. At the end of the first winding 6, the wire was secured to the insulator by folding it double, passing the doubled end through hole 22 in the insulator 20. This operation has just been done at the left end of the insulator in FIG. 6(*b*). The doubled end 23 is next opened into a loop and the loop passed around the end of the insulator. In FIG. 6(*a*) the loop 24 is shown tightened around the insulator, the excess wire having been pulled back to become part of antenna segment 2. The second bifilar coil is just being started in FIG. 6(*a*), with the wire coming out of the slot and bending 90° toward the observer at 7, and starting to wind a second coil with the winding direction the same as the direction used for the first coil. However, since the windings start from the cross-connection or middle of the coil, the second coil is wound in a clockwise direction when viewed from the left while the first coil had been wound counterclockwise when viewed from the left. If the first coil is wound with appropriate space between turns the second coil may be wound with its turns between those of the first coil, resulting in flat bifilar coils having the same diameter, as illustrated in FIGS. 3 and 4. If the first coil is close wound with its turns contiguous, the second coil may be wound on top of the first, as illustrated in FIG. 6(*b*). After finishing the second coil, the wire is again doubled, the doubled end 23 passed through a transverse hole 22 in insulator 20, the doubled wire opened to loop back around the end of the insulator as was done at the opposite end. The slack in the loop that will be formed from the doubled wire in FIG. 6(*b*) will be removed by pulling on antenna segment 1. This method of including a trap into an antenna results in the circuit of FIG. 2 for the connections between the antenna segments and the bifilar coils, with the numberings in FIGS. 2 and 6 corresponding to identical parts.

FIG. 7 shows a bifilar antenna trap included in antenna segments 25 and 26 formed from metal tubing. The trap insulator 27 is a rigid hollow cylinder with inside and outside diameters permitting it to slide into and over the tubing of the antenna. Bolts 28 are used to secure the insulator and tubing segments to one another and connect bifilar coil ends 9 and 6 to the antenna segments 25 and 26 through solder lugs 29. The electrical cross-connection 5 in this trap is an extension of end 7 of one of the bifilar coils, crossing to connect to opposite end 8 of the other coil. This embodiment uses parallel conductor cable 30 to wind the bifilar coils of the trap.

I claim:

1. A method for introducing bifilar traps into a wire antenna system having antenna segments with parallel resonant traps included between said antenna segments, whereby the antenna segments and traps may be formed from a continuous length of insulated wire, said method comprising laying a portion of insulated antenna wire that will become the cross-connection of the bifilar trap coils against an elongated insulator longitudinally, bending the wire 90° to begin winding turns of wire around the insulator perpendicular to the longitudinal axis of the insulator and over the longitudinal cross-connection wire to form a first coil on the insulator, attaching the wire that had been wrapped into the first coil to the insulator near the finish of the first coil, taking the longitudinal cross-connection wire from under the finish of the first coil, bending it 90° to begin winding this wire into a second coil of approximately the same number of turns as the first coil, with the direction of winding of the start of the second coil 180° from the direction of the start of the first coil so that the resulting bifilar coils will be inductively in a series-aiding relationship, with the turns of wire in the second coil in close proximity to the turns in the first coil in reverse order, such that the first or starting turn of the first coil is adjacent to the last or finishing turn of the second coil, the second turn is adjacent to the next-to-last turn, and so on, attaching the wire that had been wrapped into the second coil to the insulator near the finish of the second coil, extending wires from their attachments to the insulator to form antenna segments of desired lengths, starting a second trap construction by adding to the included antenna segment approximately half the length of wire that will be used in the second trap and marking this point on the wire to be the cross-connection of the second bifilar trap, laying this cross-connection portion of wire longitudinally against another elongated insulator and wrapping first and second coils on it to form a trap with the desired number of turns and resonant frequency, as was done for the first trap, and continuing the trap inclusion method for as many traps and antenna segment as desired.

2. A method according to claim 1 in which the turns of wire in the first coil are close-wound, contiguous to one another and the turns of wire in the second coil are also close-wound, contiguous to one another and surround the first coil.

3. A method according to claim 1 in which the longitudinal cross-connection wire is laid in a longitudinal slot in said insulator.

4. A method according to claim 1 in which the wire is attached to the insulator by folding the wire double, passing the doubled end through a transverse hole through the insulator, opening the doubled end to a loop, passing the loop over the end of the insulator, and tightening the attachment by removing slack from the loop back to the antenna segment portion of the wire.

5. An antenna system having at least two wire radiating portions including a parallel resonant trap between them, said trap comprising a bifilar winding of two capacitively coupled wire coils insulated from one another, an electrical cross-connection between opposite ends of said bifilar coils formed by the continuation of the wire of one coil into the opposite end of the other coil, electrical connections between said antenna radiating portions and said coils, formed by a continuation of the wire of said radiating portions into the ends of said coils that are not a part of said cross-connection, whereby the antenna system made up of traps and radiating portions is formed from a continuous length of wire.

* * * * *